United States Patent [19]

Solf et al.

[11] 4,073,058

[45] Feb. 14, 1978

[54] BARBER SCISSORS

[75] Inventors: Johannes Solf, Sindelfingen; Rolf Eicker, Solingen, both of Germany

[73] Assignee: H. Eicker & Söhne, Solingen, Germany

[21] Appl. No.: 750,685

[22] Filed: Dec. 15, 1976

[30] Foreign Application Priority Data

| | | |
|---|---|---|
| Jan. 19, 1976 | Germany | 2601687 |
| May 29, 1976 | Germany | 2624280 |

[51] Int. Cl.[2] ..... B26B 13/00

[52] U.S. Cl. ..... 30/257

[58] Field of Search ..... 30/254–262, 30/175

[56] References Cited

U.S. PATENT DOCUMENTS

| | | | |
|---|---|---|---|
| 2,294,832 | 9/1942 | Colla | 30/260 |
| 2,370,026 | 2/1945 | Elia | 30/254 |
| 2,819,523 | 1/1958 | Stoeveken | 30/260 |
| 2,939,213 | 6/1960 | Daniel | 30/260 |
| 3,066,412 | 12/1962 | Melton | 30/257 |

*Primary Examiner*—Robert C. Watson

*Attorney, Agent, or Firm*—Montague & Ross

[57] ABSTRACT

A pair of barber scissors with coplanar finger rings with scissors halves of different lengths in the region of the finger rings has a connective bolt which makes an angle of approximately 75° with the plane of the finger rings. The slightly inclined cutting angle allows cutting quite near a guide comb and permits a more natural position of the hand on the scissors.

18 Claims, 9 Drawing Figures

A
A
8
5
2
3
4
3'
12
11
1
6
7

A
A
8
α
5
9
9'
2
3
4'
3'
4''
10
1
6
7

FIG. 8
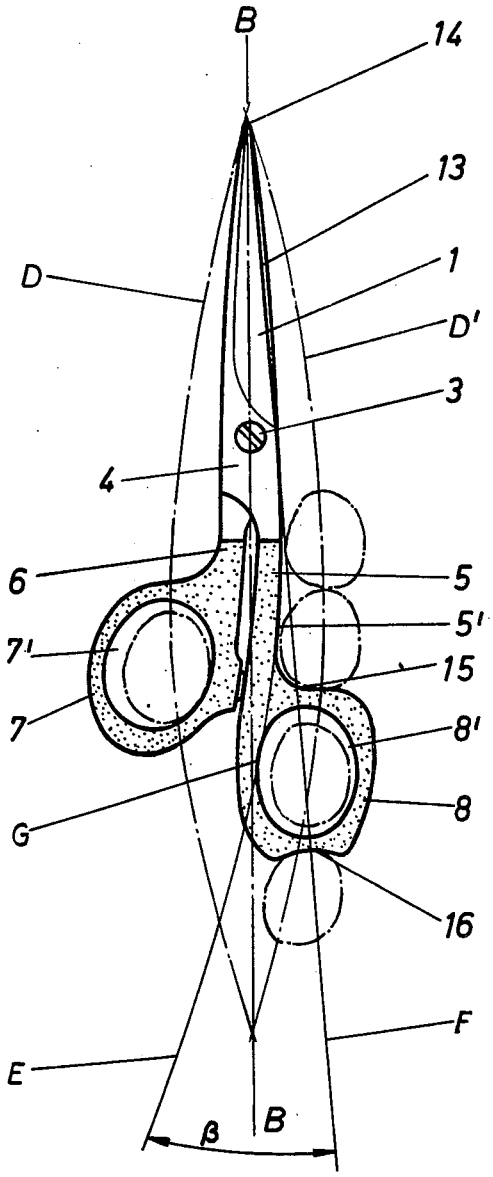
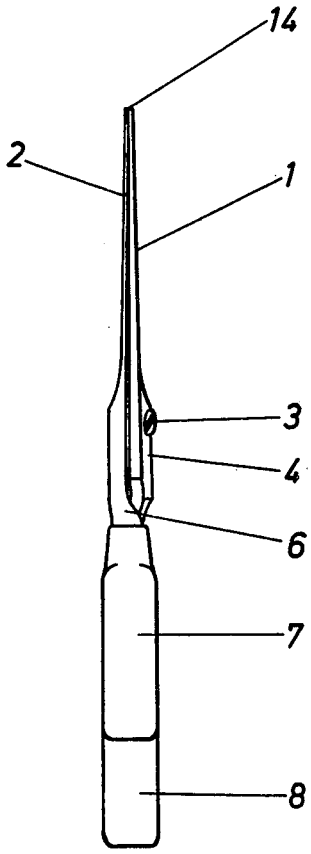
FIG. 9

BARBER SCISSORS

FIELD OF THE INVENTION

Our present invention relates to a scissors, more particularly to one designed to cut hair for extended periods, as in a barbershop or by a hairdresser.

BACKGROUND OF THE INVENTION

Known barber scissors can be very uncomfortable for the barber during hair cutting. When using a comb as a guide for the scissors, the barber must twist his hand outwards at angles up to 45° in order to maintain the proper angle of approach to the hair and to make the cut as close as possible to the plane of the comb. Since the elbow joint cannot aid such a maneuver, the rest of the body, even the knees, must compensate for the excess angle of the hand. This strange bent position, one of the occupational hazards of barbers, leads to cramps and other muscle and joint ailments.

In addition, present barber scissors are not shaped to fit the anatomy of the hand, having finger rings equally distant from the pivot bolt, often forcing the thumb and ring finger to oppose each other directly. Even scissors with longitudinally adjustable thumb rings have failed to provide a natural scissors grip.

OBJECTS OF THE INVENTION

It is therefore the object of our present invention to provide a barber scissors of the above-described general type which avoids the mentioned drawbacks.

Another object is to provide a scissors of standard cost which allows the barber to assume a more comfortable stance and hand grip while cutting hair.

SUMMARY OF THE INVENTION

The above and other objects are attained according to our present invention in a pair of barber scissors in which both finger rings are coplanar, the half of the scissors with the finger ring for the ring finger being longer than the other, a pivot bolt connecting both halves of the scissors, and the bolt making an acute angle with the plane of the finger rings.

According to one feature of our invention, the acute angle is between 60° and 80°, with a preferred value of 75°. The outer surfaces of the blades are parallel with the plane of the finger rings, while the inner surfaces of the blades are inclined with the acute angle. The halves of the scissors can differ in length between 5 and 30 mm, up to a spacing of one ring diameter.

The finger rings of the scissors are made of plastic and bonded to the metal blades and legs in the conventional manner. Conventional also is the addition of half-moon-shaped cams to the facing surfaces of the legs to effect a snug closure of the scissors.

According to another feature of the invention, the longer leg curves across a central axis of the scissors at an acute angle, permitting the fingers and thumb to be arranged along a pair of mirror-symmetrical bowed lines around the central axis.

BRIEF DESCRIPTION OF THE DRAWING

The above and other features of our present invention will now be described in detail with reference to the accompanying drawing in which:

FIG. 8 is a top view of another embodiment of our present invention; and

FIG. 9 is a side view of the device of FIG. 8.

SPECIFIC DESCRIPTION

Figure 1:
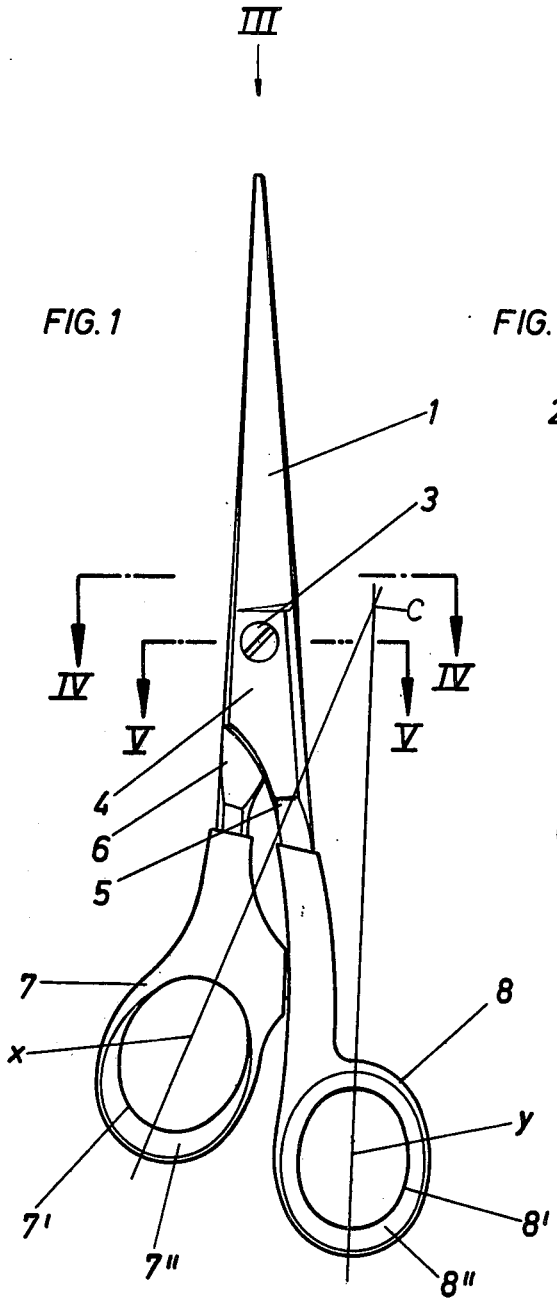
FIG. 1 is a top view of a scissors according to our present invention.
Figure 2:
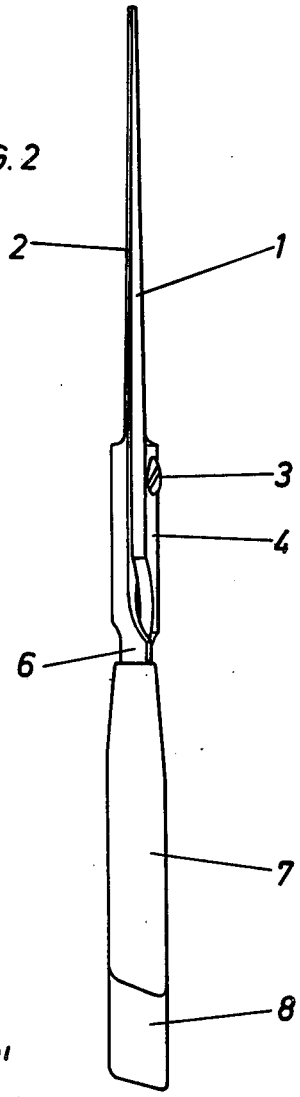
FIG. 2 is a side view of the device of FIG. 1.
Figure 3:
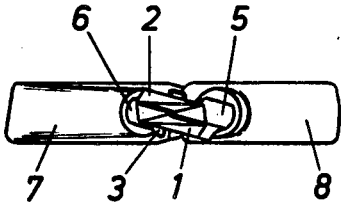
FIG. 3 is a view of FIG. 1 along arrow III.

As seen in FIGS. 1, 2, 3, 6 and 7, a pair of barber scissors having opposite blades 1, 2 with their respective legs 5, 6 and finger rings 8, 7, are joined at a midsection 4 by a pivot bolt 3. The finger rings 7, 8 have oval-shaped openings 7', 8' for the thumb and ring finger, respectively, with the ring 8 being more distant than the ring 7 from the bolt 3. Lines x and y extend the long axes of the ovals to their interaction at point C, almost directly opposite from the bolt 3 displaced towards the side of the ring 8. Their included angle, between 10° and 40°, has a preferred value between 20° and 25°. Conical contact surfaces 7'' and 8'' on the rings 7 and 8 ease the grasping of the thumb and ring finger, respectively.

Figure 4:
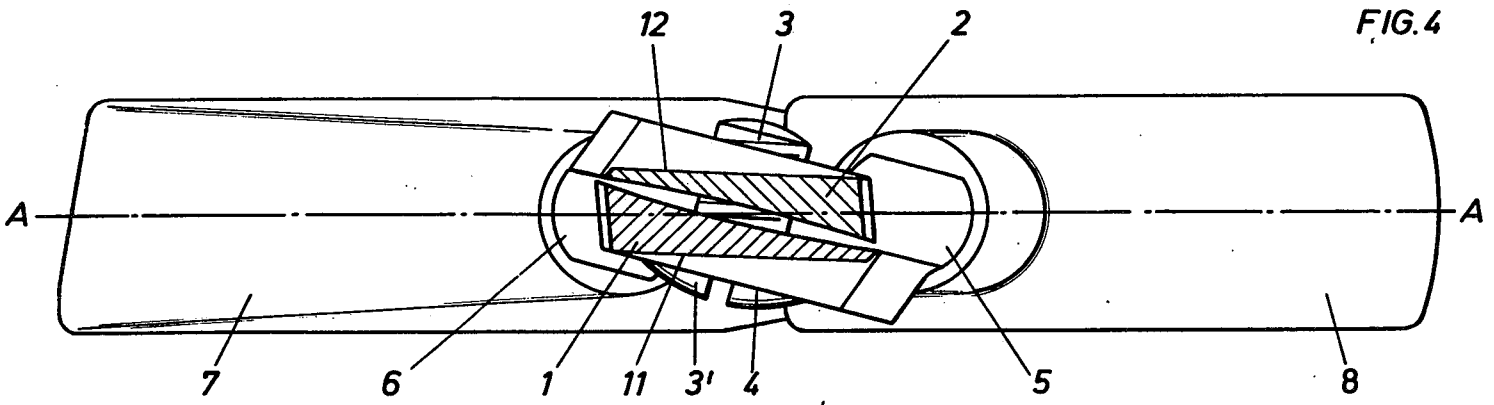
FIG. 4 is a cross-sectional view of the device of FIG. 1 taken along line IV — IV.
Figure 5:
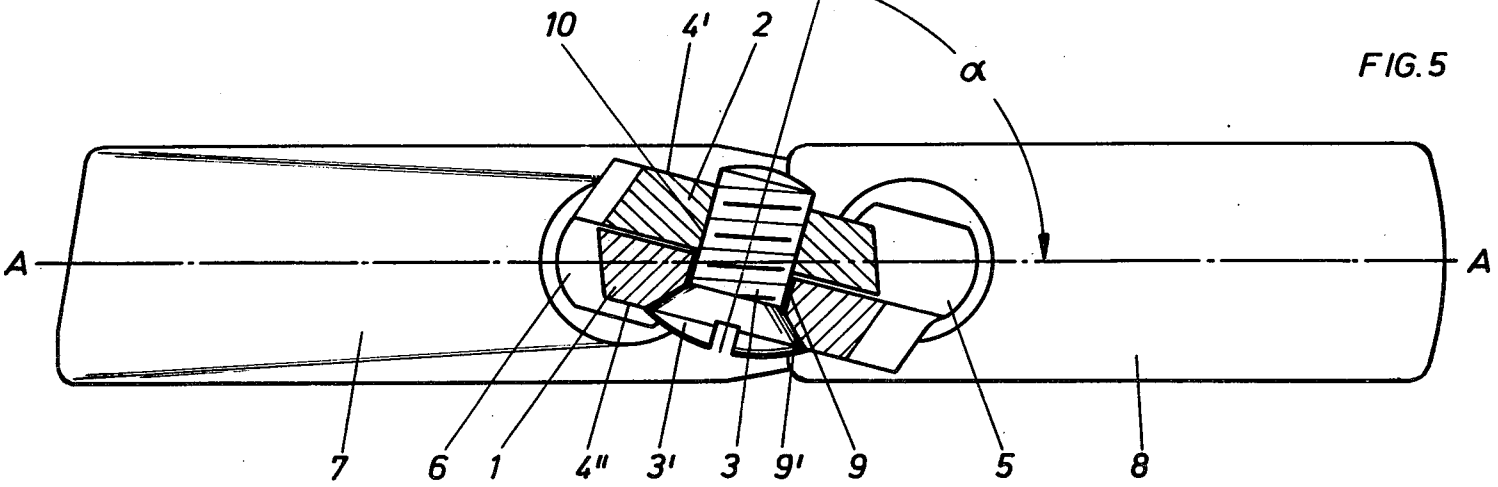
FIG. 5 is a cross-sectional view of the device of FIG. 1 taken along line V — V.
Figure 6:
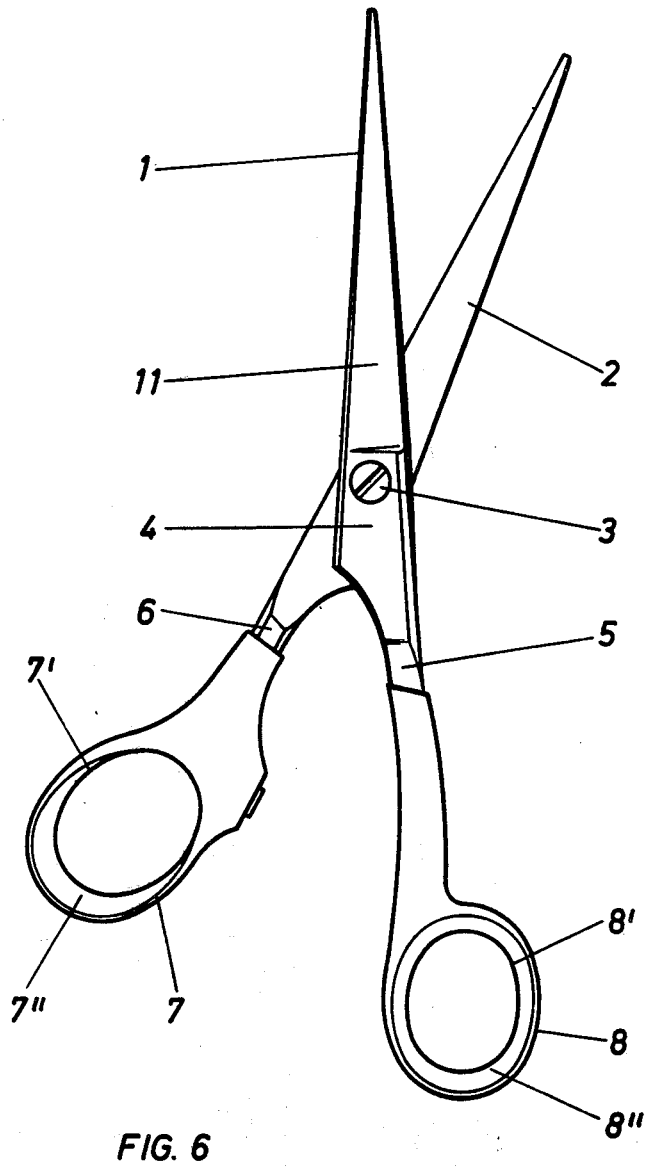
FIG. 6 shows the device of FIG. 1 in another position.
Figure 7:
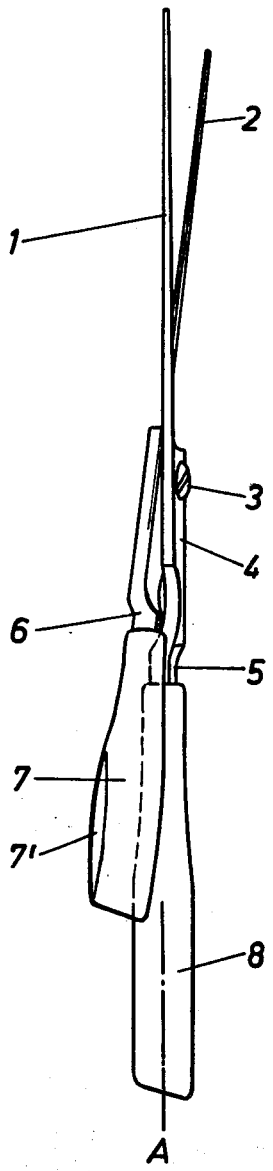
FIG. 7 shows the device of FIG. 2 in another position.

FIGS. 4 and 5 show the finger rings 7 and 8 arranged about a common plane A. The pivot bolt 3 makes an acute angle $\alpha$ with the plane A, whereas the outer surfaces 11, 12 of the blades 1, 2 are parallel to it. The midsection 4 and its associated outer surfaces 4', 4'' are formed with a hole 9, a threaded hole 10 and a countersink 9' for accepting the bolt 3, whose head 3' projects beyond the surface 4''.

FIGS. 8 and 9 show another pair of barber scissors with a similarly sloped pivot bolt 3. The long leg 5 has a curved outer edge 5' along arc E, E being tangent to the finger ring opening 8' at point G. The ring 8 is provided with depressions 15, 16 for the flanking middle and little fingers, respectively. A center line B runs through the bolt 3 and a tip 14 of the scissors. Two bowed lines D, D' disposed in a mirror-symmetrical relationship about the line B show the natural alignment of the fingers and thumb resulting from the arrangement of the curved longer leg 5 with set-back finger ring 8. A line F extends the line of a cutting edge 13 and intersects the bowed line D' inside the opening 8'. Arc E makes an acute angle with line B where it crosses, near point G, and another acute angle $\beta$ with line F.

During haircutting, both described embodiments of the invention permit a more comfortable hand position, based upon the physical shape of the hand. The angle of the cutting plane offset from the plane of the finger rings allows the thumb to move out of the ring plane upon opening the scissors, and back into it upon closing, following natural motion (best seen in FIGS. 6 and 7).

The angled cutting plane also permits closer cutting to a guide comb, resulting in a more accurate haircut and a less twisted hand position. Scissors could be produced in right and left handed versions to accommodate every barber's preference.

The arrangement of the legs and rings according to the bowed and curved lines of FIGS. 8 and 9 not only provides a comfortable grip, but also one which gives the most sensitive control of the scissors, especially the tip.

We claim:

1. In a barber scissors having two halves, each including a blade provided with a tip and a cutting edge, a midsection having a pivot point, and a leg connecting said pivot point to a finger ring, said halves being operably linked at the pivot point by a bolt, the scissors having a central axis through said bolt and the tips in a closed position, the improvement wherein:

said finger rings are coplanar, a first half has a long leg while a second half has a short leg, and said bolt makes an acute angle ranging between substantially 60° and 80° with the plane of said finger rings, said legs being of different lengths with said finger rings being staggered by a distance of substantially a diameter of one finger ring, the longer leg being curved to cross said axis at an acute angle.

2. The scissors defined in claim 1 wherein said acute angle is 75°.

3. The scissors defined in claim 1 wherein an inner surface of each said blade is inclined with said acute angle.

4. The scissors defined in claim 3 wherein an outer surface of each said blade is generally parallel to the plane of said finger rings.

5. The scissors defined in claim 1 wherein the tips of said blades and said bolt are colinear on a central axis of said scissors in a closed position thereof.

6. The scissors defined in claim 1 wherein said long leg extends between substantially 5 and 30 mm farther from said bolt than said short leg.

7. The scissors defined in claim 1 wherein said bolt is provided with a head which is countersunk into said midsection.

8. The scissors defined in claim 1 wherein said finger rings are made of plastic.

9. The scissors defined in claim 1 wherein the finger ring for the ring finger is found on said first half and the finger ring for the thumb is found on said second half.

10. The scissors defined in claim 1 wherein said finger rings have oval-shaped openings for their associated fingers.

11. The scissors defined in claim 10 wherein said finger rings have conical-shaped inner edges defining said oval-shaped openings.

12. The scissors defined in claim 10 wherein said oval-shaped openings are aligned with their respective long axes intersecting at a point in the vicinity of said bolt.

13. The scissors defined in claim 12 wherein said long axes have an included angle between substantially 10° and 40°.

14. The scissors defined in claim 1 wherein said finger ring on said long leg is provided with depressions on its outer boundary to accept the middle and little fingers.

15. The scissors defined in claim 1 wherein the line defining the curve of said longer leg is tangent to its respective finger ring at a point where an opening is provided for the ring finger.

16. The scissors defined in claim 15 wherein said point is located in the vicinity of said central axis.

17. The scissors defined in claim 1 wherein said finger rings are positioned on said scissors according to a pair of bowed lines mirror-symmetrical about said central axis having a first common terminus on said axis at said tip and a second common terminus on said axis beyond said longer leg, the fingers and the thumb falling on said bowed lines when grasping said scissors in a closed position.

18. The scissors defined in claim 17 wherein said line makes an acute angle with a linear extension of the cutting edge of its associated blade.

* * * * *